US010108134B2

(12) United States Patent
Mae et al.

(10) Patent No.: US 10,108,134 B2
(45) Date of Patent: Oct. 23, 2018

(54) IMAGE FORMING APPARATUS AND PROGRAM FOR IMAGE FORMING APPARATUS

(71) Applicant: KONICA MINOLTA, INC., Chiyoda-ku, Tokyo (JP)

(72) Inventors: Hideo Mae, Kitanagoya (JP); Tatsutoshi Yamada, Toyokawa (JP); Atsushi Kawai, Toyokawa (JP); Hideaki Komiyama, Ibaraki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/904,268

(22) Filed: Feb. 23, 2018

(65) Prior Publication Data

US 2018/0275598 A1 Sep. 27, 2018

(30) Foreign Application Priority Data

Mar. 21, 2017 (JP) ..... 2017-054886

(51) Int. Cl.

| | |
|---|---|
| ***G03G 21/16*** | (2006.01) |
| ***G03G 21/00*** | (2006.01) |
| ***G03G 9/08*** | (2006.01) |
| ***G03G 15/00*** | (2006.01) |
| ***G03G 15/02*** | (2006.01) |

(52) U.S. Cl.

CPC ..... *G03G 21/0088* (2013.01); *G03G 9/0825* (2013.01); *G03G 15/0275* (2013.01); *G03G 15/50* (2013.01)

(58) Field of Classification Search

CPC ..... G03G 21/16

See application file for complete search history.

(56) References Cited

U.S. PATENT DOCUMENTS

2008/0267640 A1* 10/2008 Hamaya ..... G03G 15/5041 399/26

2011/0293295 A1 12/2011 Shinohara

FOREIGN PATENT DOCUMENTS

JP 2012008539 A 1/2012

* cited by examiner

*Primary Examiner* — Clayton E Laballe
*Assistant Examiner* — Jas Sanghera
(74) *Attorney, Agent, or Firm* — Holtz, Holtz & Volek PC

(57) ABSTRACT

An image forming apparatus includes: a photosensitive member; a charger that charges a surface of the photosensitive member; an exposure device that forms a latent image; and a developing device that applies toner to the latent image, wherein the photosensitive member is incorporated in a detachable photosensitive member unit, and the developing device is incorporated in a detachable developing unit, the image forming apparatus including: an optimization controller that performs optimization of a charging bias of the charger and a developing bias of the developing device; and a replacement determiner that determines which of the photosensitive member unit and the developing unit is to be replaced when an optimized developing bias is out of a predetermined allowable range, wherein the replacement determiner determines that the developing unit is to be replaced, and determines that the photosensitive member unit is to be replaced.

16 Claims, 7 Drawing Sheets

| DEVELOPING BIAS [V] | | NUMBER OF PHOTOSENSITIVE MEMBERS | | |
|---|---|---|---|---|
| | | FIRST | SECOND | THIRD |
| PHOTOSENSITIVE MEMBER ROTATION TIME [min] | 0 | 480 | 430 | 380 |
| | 1000 | 454 | 404 | 354 |
| | 2000 | 429 | 379 | 329 |
| | 3000 | 403 | 353 | 303 |
| | 4000 | 377 | 327 | 277 |
| | 5000 | 351 | 301 | 251 |
| | 6000 | 326 | 276 | 226 |
| | 7000 | 300 | 250 | 200 |

PRESENT

FIG. 9

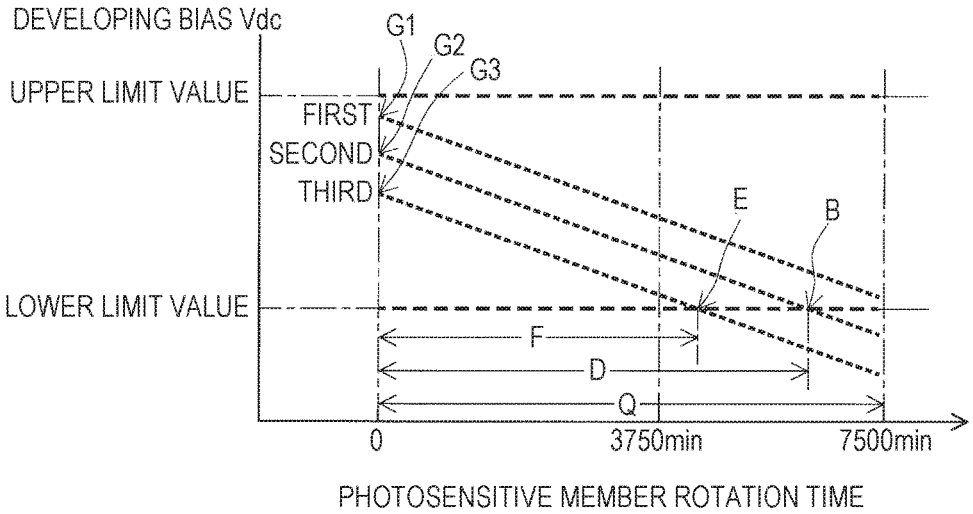

FIG. 10

| ITEM | SYMBOL | UNIT |
|---|---|---|
| NUMBER OF PHOTOSENSITIVE MEMBERS THAT HAS BEEN FULLY USED AFTER REPLACING DEVELOPING DEVICE | N | PIECES |
| NUMBER OF PRINTED SHEETS UP TO PRESENT, AFTER REPLACING DEVELOPING DEVICE | H | SHEETS |
| NUMBER OF SHEETS OF DEVELOPING DEVICE LIFETIME EXTENSION BY REPLACING PHOTOSENSITIVE MEMBER | R | SHEETS |
| DEVELOPING UNIT PRICE | Udev | YEN |
| PHOTOSENSITIVE MEMBER UNIT PRICE | Upc | YEN |
| WEAR RATE OF PHOTOSENSITIVE MEMBER CURRENTLY IN USE | $\alpha$ | % |
| WEAR RATE THAT CAN BE EXPECTED FOR PHOTOSENSITIVE MEMBER NEWLY REPLACED | $\beta$ | % |

IMAGE FORMING APPARATUS AND PROGRAM FOR IMAGE FORMING APPARATUS

The entire disclosure of Japanese patent Application No. 2017-054886, filed on Mar. 21, 2017, is incorporated herein by reference in its entirety.

BACKGROUND

Technological Field

The present invention relates to an image forming apparatus that uses toner to form an image. More specifically, the present invention relates to an image forming apparatus in which a photosensitive member and a developing device are unitized to be separately replaceable. In addition, a program that controls such an image forming apparatus is also targeted.

Description of the Related Art

Conventionally, there is an image forming apparatus that uses toner and in which a developing device is unitized to be replaceable. In such an image forming apparatus, the end of the lifetime of the developing device is reached due to execution of image formation. For that reason, there is a device that performs lifetime management of the developing device based on an index value such as the number of images to be formed. Meanwhile, in a recent image forming apparatus, not only the developing device but also a photosensitive member is unitized, and the photosensitive member is replaceable separately from replacement of the developing unit in some cases.

An example of such an image forming apparatus is disclosed in JP 2012-008539 A. In the image forming apparatus disclosed in JP 2012-008539 A, notice of being near the end of the lifetime of a latent image unit (photosensitive member unit) is performed only in a case where both the latent image unit and the developing unit are near the end of the lifetime. That is, even if the latent image unit has reached a state of being near the end of the lifetime, the notice is not performed only by that (see [0017] and FIG. 3 of JP 2012-008539 A). This is because in the apparatus disclosed in JP 2012-008539 A, the number of images that can be formed from "near the end of the lifetime" to "the end of the lifetime" of the latent image unit is greater than the number of images that can be formed from "near the end of the lifetime" to "the end of the lifetime" of the developing unit ([0016] of JP 2012-008539 A).

However, in the above-described conventional techniques, there have been the following problems. In the apparatus of JP-A-2012-008539, the lifetime itself of the latent image unit or the developing unit is basically determined by rotation time of the photosensitive member and rotation time of the developing roller ([0016] of JP 2012-008539 A). That is, the lifetime of each of the latent image unit and the developing unit is independently set. For that reason, it has been necessary to set the lifetime attic developing unit so that image quality is maintained regardless of the state of the latent image unit. For this reason, depending on the situation, there have been cases where it is forced to replace the developing unit even though image formation is possible with sufficiently high image quality. This is a case where the developing unit reaches the end of the set lifetime in a state in which the latent image unit is still close to a new one. There has been a similar problem with respect to the lifetime of the latent image unit.

SUMMARY

The present invention has been made to solve the problems of the above-described conventional techniques. That is, an object of the present invention is to provide an image forming apparatus and a program for the image forming apparatus in which replacement determination is efficiently made for the developing unit and the photosensitive member unit in accordance with the situations of the both units.

To achieve the abovementioned object, according to an aspect of the present invention, an image forming apparatus reflecting one aspect of the present invention comprises: a photosensitive member that rotates; a charger that charges a surface of the photosensitive member; an exposure device that forms a latent image on a position of the surface of the photosensitive member charged by the charger; and a developing device that applies toner to the latent image to form a toner image, wherein the photosensitive member is incorporated in a detachable photosensitive member unit, and the developing device is incorporated in a detachable developing unit, the image forming apparatus including: an optimization controller that performs optimization of a charging bias of the charger and a developing bias of the developing device at time of non-image formation; and a replacement determiner that determines which of the photosensitive member unit and the developing unit is to be replaced when an optimized developing bias that is the developing bias at time of optimization by the optimization controller is out of a predetermined allowable range, wherein the replacement determiner determines that the developing unit is to be replaced in a case where a usage situation until then corresponds to a predetermined developing device replacement matter, and determines that the photosensitive member unit is to be replaced in a case where it is not determined that the developing unit is to be replaced.

BRIEF DESCRIPTION OF THE DRAWINGS

The advantages and features provided by one or more embodiments of the invention will become more fully understood from the detailed description given hereinbelow and the appended drawings which are given by way of illustration only; and thus are not intended as a definition of the limits of the present invention:

FIG. 9 is a graph plotting contents of FIG. 8;

FIG. 10 is a table of parameters used for cost calculation;

DETAILED DESCRIPTION OF EMBODIMENTS

Figure 1:
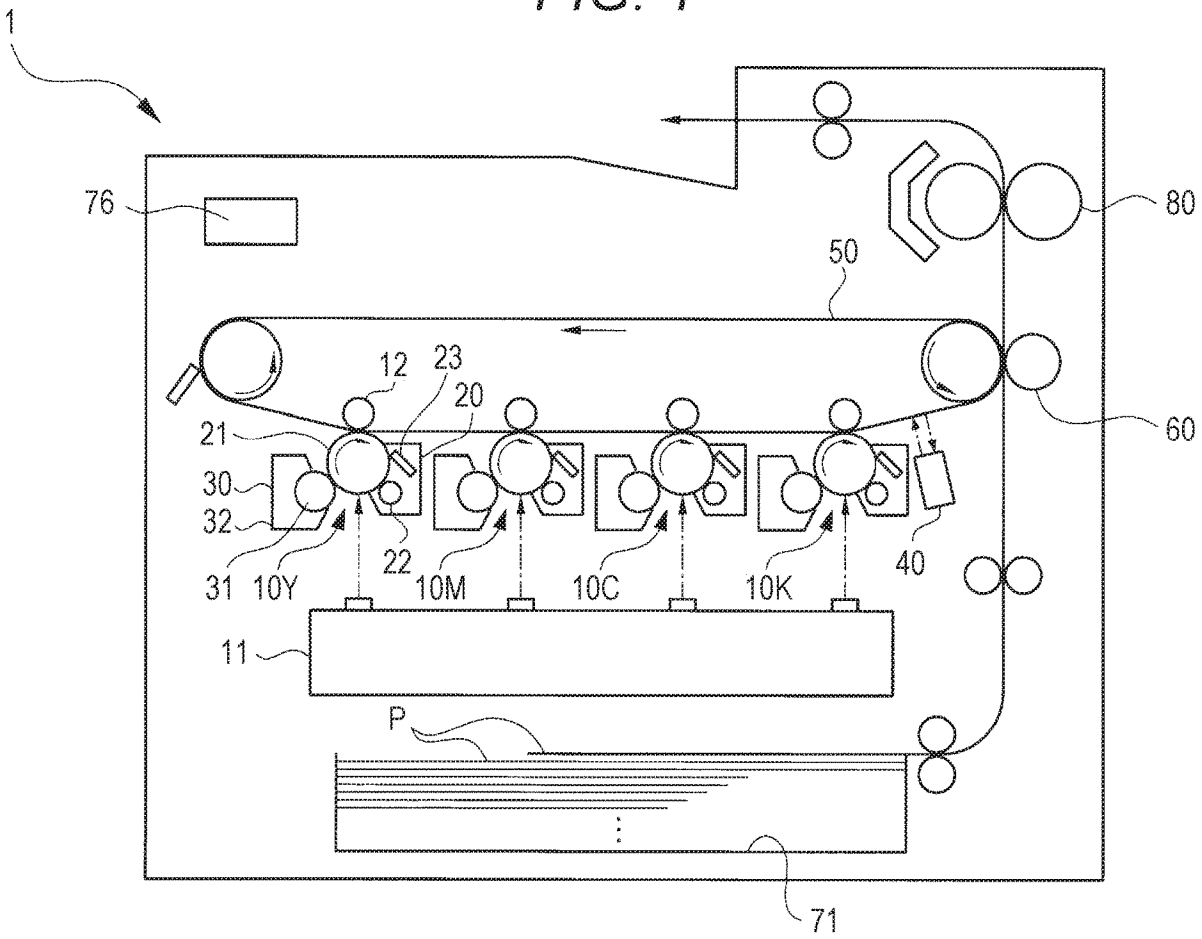
FIG. 1 is a cross-sectional view illustrating a schematic configuration of an image forming apparatus according to an embodiment.

Hereinafter, one or more embodiments of the present invention will be described in detail with reference to the drawings. However, the scope of the invention is not limited to the disclosed embodiments. In the present embodiment, the present invention is applied to an image forming apparatus 1 illustrated in FIG. 1. The image forming apparatus 1 in FIG. 1 includes an intermediate transfer belt 50, image forming devices 10 (10Y, 10M, 10C, and 10K) of respective four colors (Y, M, C, and K), and a paper feed cassette 71. As a result, an image is formed with toner on printing paper P.

In more detail, each of the image forming devices 10 includes a photosensitive member 21 and a developing device 30. The image forming apparatus 1 further includes an exposure device 11 that writes a latent image on each photosensitive member 21, a transfer roller 60 that transfers a toner image from the intermediate transfer belt 50 to the printing paper P, a fixing device 80 that fixes the toner image on the printing paper P, and a toner image sensor 40 that detects the toner image on the intermediate transfer belt 50. The image forming apparatus 1 is also includes a controller 76. The controller 76 incorporates a control program and control data for executing various types of operation of the image forming apparatus 1. The control program includes a lifetime determination program to be described later. In addition, because of the lifetime determination program, rotation time of the photosensitive member 21 due to image formation and the number of printed sheets are counted up.

Figure 2:
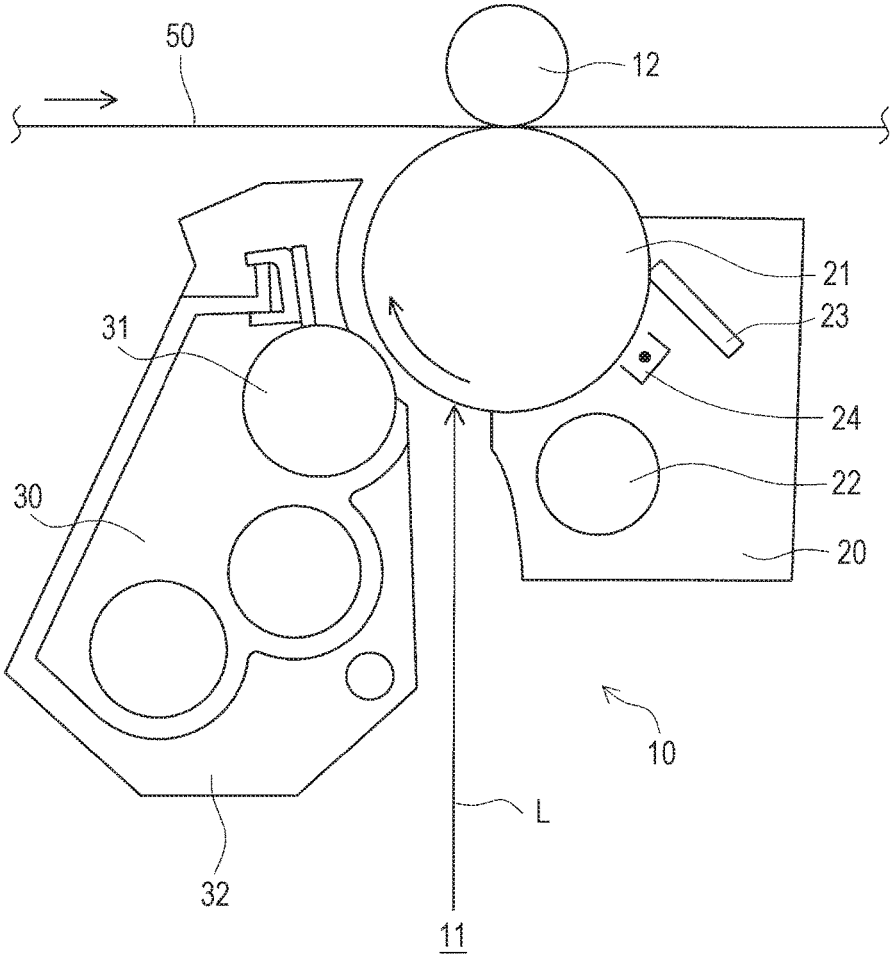
FIG. 2 is a cross-sectional view illustrating a configuration of an image forming device in the image forming apparatus according to the embodiment.

The image forming device 10 will be further described with reference to the cross-sectional view of FIG. 2. As illustrated in FIG. 2, the developing device 30 of the image forming device 10 includes a developing roller 31. The developing device 30 in the present embodiment incorporates so-called two-component type developer including the toner and carrier. The developing device 30 has a configuration that forms a layer of the developer on a surface of the developing roller 31 and applies the toner to the latent image of the photosensitive member 21 from the layer. Also, the developing device 30 is incorporated in a developing unit 32 that is a detachable unit with respect to the image forming apparatus 1.

As further illustrated in FIG. 2, a cleaner 23, an eraser 24, and a charger 22 are provided around the photosensitive member 21. The photosensitive member 21, the cleaner 23, the eraser 24, and the charger 22 integrally configure a photosensitive member unit 20 that is detachable with respect to the image forming apparatus 1. Attachment/detachment of the photosensitive member unit 20 and attachment/detachment of the developing unit 32 can be performed independently of each other. In addition, a replacement history of the photosensitive member unit 20 and the developing unit 32 to new ones is recorded in the controller 76. Incidentally, the developing device 30 and the photosensitive member unit 20 illustrated in FIG. 1 are drawn somewhat simpler than those in FIG. 2.

In addition, the photosensitive member unit 20 and the developing unit 32 are arranged such that writing light L from the exposure device 11 is emitted to the photosensitive member 21 through a gap between the photosensitive member unit 20 and the developing unit 32. Further, a transfer roller 12 is provided on a back side of the intermediate transfer belt 50 as viewed from the photosensitive member 21. As a result, in the image forming apparatus 1, a latent image is written with the writing light L at a position that is on a surface of the photosensitive member 21 and charged by the charger 22, and a toner image is formed on the latent image by the developing device 30. Such a toner image is superimposed on the intermediate transfer belt 50 and is transferred onto the printing paper P.

In the image forming apparatus 1 of the present embodiment, image stabilization control is performed in addition to normal image forming operation. The image stabilization control is a control that adjusts various process conditions to optimize image quality of the toner image formed in the normal image forming operation, and is performed at times other than the time of image formation. The image stabilization control is executed immediately after turning on the power or at timing for each predetermined number of printed sheets. The image stabilization control is also performed when there is a change in environmental conditions. Adhesion amount adjustment control is included as part of the image stabilization control. The adhesion amount adjustment control is a control that adjusts a developing bias of the developing device 30 to optimize a toner adhesion amount of the toner image to be formed.

Figure 3:
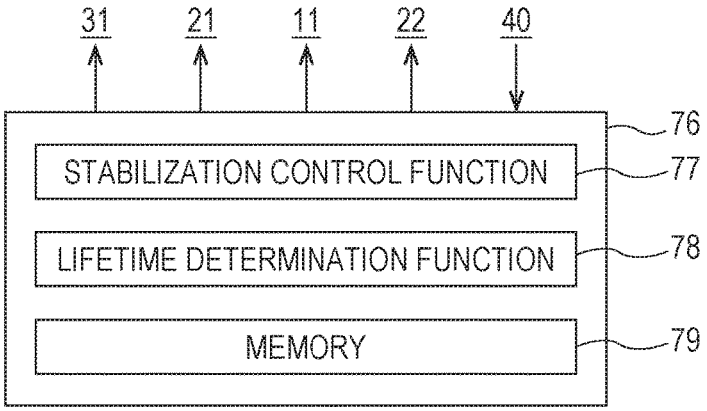
FIG. 3 is a block diagram illustrating a main part of a control system of the image forming apparatus according to the embodiment.

FIG. 3 illustrates a configuration of a control system of the image forming apparatus 1 of the present embodiment. This control system is configured mainly by the controller 76. The controller 76 operates the developing bias of the developing roller 31, rotation of the photosensitive member 21, light emitting operation of the exposure device 11, a charging bias of the charger 22, and the like. In addition, read data from the toner image sensor 40 is provided to the controller 76. The controller 76 includes a stabilization control function 77 for performing the image stabilization control, and a lifetime determination function 78 executed by the lifetime determination program. The controller 76 also incorporates memory 79 that stores various data.

Figure 4:
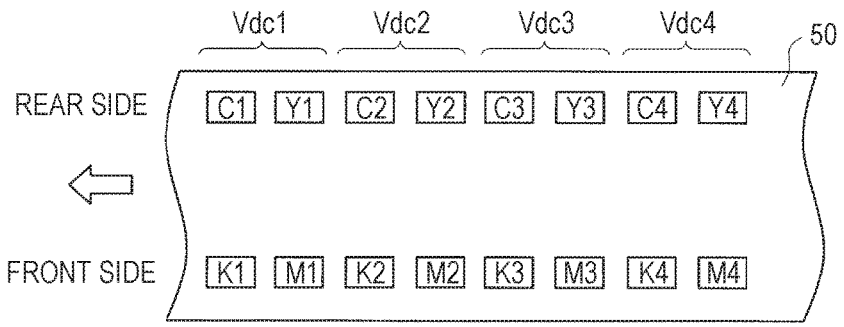
FIG. 4 is a plan view illustrating a test pattern formed by adhesion amount adjustment control.
Figure 5:
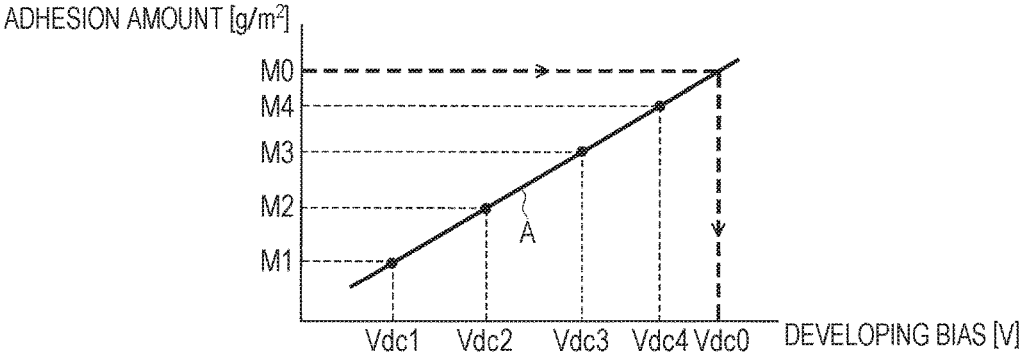
FIG. 5 is a graph illustrating a relationship between a developing bias and an adhesion amount in the adhesion amount adjustment control.

Details of the adhesion amount adjustment control will be described with reference to FIGS. 4 and 5. In the adhesion amount adjustment control, as illustrated in FIG. 4, a test pattern of each color is formed on the intermediate transfer belt 50 by multiple levels of developing biases. Here, an example is illustrated using four levels of developing biases from Vdc1 to Vdc4. A density (toner adhesion amount) of each of these test patterns is read by the toner image sensor 40. The toner adhesion amount read is plotted against the developing bias as illustrated in FIG. 5. An approximate straight line A is drawn by this plot. By using the approximate straight line A, a developing bias Vdc0 for obtaining a target adhesion amount. MO is determined. The developing bias Vdc0 thus determined is used for subsequent image formation. An example of M color is illustrated in FIG. 5, and the same is done for other colors.

Figure 6:
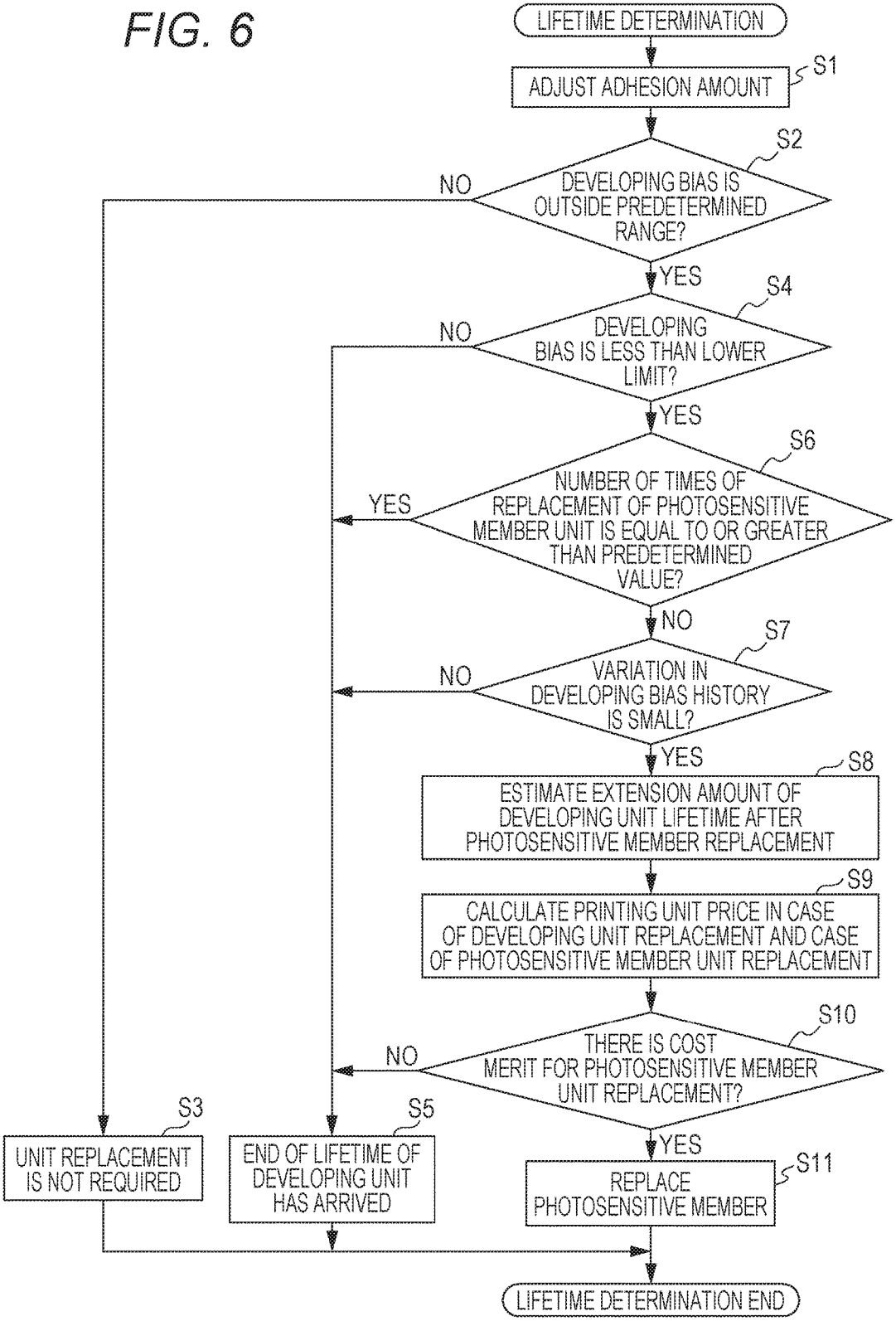
FIG. 6 is a flowchart illustrating details of a lifetime determination program.

In the image forming apparatus 1 of the present embodiment, following the adhesion amount adjustment control, the lifetime determination program is executed for the developing unit 32 and the photosensitive member unit 20. This is because the developing bias Vdc0 determined as described above includes information on a remaining lifetime of the developing unit 32. By executing this lifetime determination program, a user is prompted to replace the developing unit 32 or the photosensitive member unit 20 with a new one appropriately as necessary. When replacement is actually performed, a history of the replacement is recorded in the memory 79 of the controller 76. In the present embodiment, since the developing unit 32 is more expensive than the photosensitive member unit 20, replacement of the developing unit 32 is suppressed to a minimum necessary. The lifetime determination program is executed for each color. FIG. 6 illustrates details of the lifetime determination program.

In a flow of FIG. 6, first, the above-described adhesion amount adjustment control is executed (S1). As a result, the developing bias Vdc0 is determined for each color. Then, before the normal image forming operation is started, lifetime determination is executed in S2 and subsequent steps. The determined developing bias Vdc0 is stored in the memory 79 of the controller 76 together with its history.

Figures 7, 8:
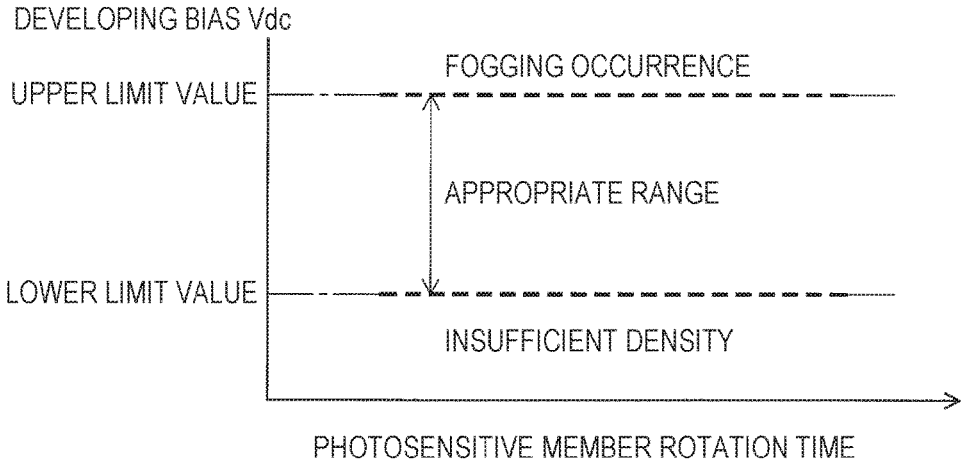
FIG. 7 is a graph illustrating an appropriate range of the developing bias.
FIG. 8 is a table of developing biases.

In the lifetime determination, first in S1, it is determined whether or not the developing bias Vdc0 is out of its appropriate range (S2). The appropriate range of the developing bias Vdc0 is determined for each color in advance as illustrated in FIG. 7, and is stored in the memory 79 of the controller 76. In a case where the determined developing bias Vdc0 is within the appropriate range (S2: No), it is determined that unit replacement is not required (S3). In this case, neither the developing unit 32 nor the photosensitive member unit 20 is replaced. In addition, the appropriate range of the developing bias Vdc0 determined in advance may be two levels, an appropriate range for determining that the end of the lifetime has actually arrived and an appropriate range for advance notice of that.

In a case where the developing bias Vdc0 determined in S1 is out of the appropriate range (S2: Yes), it is determined whether or not the developing bias Vdc0 is less than a lower limit (for example, 270 [V]) of the appropriate range (S4). If it is not less than the lower limit (S4: No), an upper limit of the appropriate range (for example, 550 [V]) is exceeded. In this case, if image formation is performed as it is, there is a high possibility that fogging occurs and only low image quality can be obtained. Therefore, in this case, it is determined that the end of the lifetime has arrived of the developing unit 32 (S5). This is because, this phenomenon of a rise of the developing bias Vdc0 is basically caused by deterioration of the developing roller 31 or deterioration of the developer, and it is not caused by the photosensitive member unit 20. For this reason, the developing unit 32 has to be replaced. Therefore, the image formation is stopped and a message is issued to the user prompting to replace the developing unit 32 with a new one. Alternatively, a message to the user is issued to the effect that the end of the lifetime is approaching of the developing unit 32.

In a case where the developing bias Vdc0 is less than the lower limit of the appropriate range (S4: Yes), if the image formation is performed as it is, there is a high possibility that only images with low image density can be obtained. In this case, however, there is a possibility that the image quality can be restored by replacement of the photosensitive member unit 20 instead of replacement of the developing unit 32. Therefore, the number of times of replacement of the photosensitive member unit 20 is checked. That is, the number of times of replacement of the photosensitive member unit 20 is compared with a reference number of times determined in advance, and it is determined whether or not the number of times of replacement is equal to or greater than the reference number of times (S6). Here, the number of times of replacement of the photosensitive member unit 20 to be compared is the number of times of replacement of the photosensitive member unit 20 after the developing unit 32 becomes the present one. The number of times of replacement is grasped from the replacement history to new ones of the photosensitive member unit 20 and the developing unit 32 recorded in the memory 79 of the controller 76. The reference number of times is stored in the memory 79 of the controller 76.

In a case where the number of times of replacement of the photosensitive member unit 20 is equal to or greater than the reference number of times (S6: Yes), the developing unit 32 at present has already become considerably old. For that reason, in this case, it is determined that the end of the lifetime has arrived of the developing unit 32 (S5). On the other hand, in a case where the number of times of replacement has not reached the reference number of times (S6: No), the developing unit 32 at present has not become so old yet. For this reason, further determination is trade. This is because there is a possibility that the image quality can be restored by replacing the photosensitive member unit 20.

The next determination is determination on magnitude of variation in the developing bias Vdc0 determined in the past. For this reason, the history is referred to of the developing bias Vdc0 stored in the memory 79 of the controller 76. Then, the variation is calculated in a most recent predetermined number of times of developing biases Vdc0 including the latest value. The predetermined number of times is determined in advance. This variation is compared with a predetermined upper limit variation, and it is determined whether or not the calculated variation is equal to or less than the upper limit variation (S7).

In a case where the variation exceeds the upper limit variation (S7: No), the developing unit 32 at present has already considerably deteriorated. For that reason, in this case, it is determined that the end of the lifetime has arrived of the developing unit 32 (S5). On the other hand, in a case where the variation is equal to or less than the upper limit variation (S7: Yes), the developing unit 32 at present has not deteriorated so much yet. For this reason, further determination is made.

The next determination is based on a comparison of predicted costs between a case where the developing unit 32 is replaced and a case where the photosensitive member unit 20 is replaced. In short, it is which one of the developing unit 32 and the photosensitive member unit 20 currently in use has a higher remaining value. For this reason, first, an extension amount is estimated of the lifetime of the developing unit 32 that can be expected in a case where the photosensitive member unit 20 is replaced (S8). This estimation is performed as follows.

First, referring to the history of the developing bias Vdc0 stored in the memory 79 of the controller 76, a table is created as illustrated in FIG. 8. The table of FIG. 8 illustrates transition of the developing bias Vdc0 determined every 1000 minutes as the rotation time of the photosensitive member 21 since the developing unit 32 at present was mounted. The table illustrated in FIG. 8 assumes a point in time when the developing bias Vdc0 reaches the lower limit while the second photosensitive member unit 20 is mounted and operating, as the developing unit 32 at present.

The column of "first" of "number of photosensitive members" in the table indicates the transition of the developing bias Vdc0 when the first photosensitive member unit 20 was mounted and operating as the developing unit 32 at present. In the same column, it can be seen that the developing bias Vdc0 started from 480 [V] at the beginning, and gradually decreased. Incidentally, in the same column in FIG. 8, the description is stopped at a row where the bias Vdc0 is 300

[V], in which the rotation time of the photosensitive member 21 is 7000 minutes; however, the actual first photosensitive member unit 20 was replaced after the developing bias Vdc0 became lower than 270 [V]. The "second" column in the table indicates the transition of the developing bias Vdc0 after the second photosensitive member unit 20 was mounted as the developing unit 32 at present. The current situation is where the bias Vdc0 is 250 [V], in which the rotation time of the photosensitive member 21 is 7000 minutes.

The "third" column in the same table indicates transition prediction of the future developing bias Vdc0 by estimation instead of the past history. That is, the developing bias value of the first row in the same column is a predicted value based on a developing bias difference between the developing biases of the "first" column and the "second" column in the first row, and the developing bias Vdc0 of the first row in the "second" column. Similarly, predicted values of the "3rd" column are also entered for the second and subsequent rows. From the predicted values, it can be estimated that the developing bias Vdc0 falls below 270 [V] at about 5000 minutes of the rotation time of the photosensitive member 21 in a case where the image formation is continued by replacing the photosensitive member unit 20 with the third one.

The contents of FIG. 8 are plotted on the graph in FIG. 9. In FIG. 9, an intersection B between the "second" graph and the horizontal line of the "lower limit value" is the current position. The horizontal axis position of an intersection point E of the "third line" graph and the "lower limit value" horizontal line is tried to be expected. A distance F from a zero point to the intersection point in the horizontal axis (the rotation time of the photosensitive member 21) is the extension amount of the lifetime of the developing unit 32 that can be expected by replacing the photosensitive member unit 20 from the "second" to the "third". The distance F is regarded as the estimated value of the extension amount.

The third graph can be drawn as follows. That is, a start point G3 is placed at an equal interval with respect to start points G1 and G2 of the "first" and "second" graphs (intersection points between a vertical line of the zero point and the "first" and "second" graphs). Then, the "third" graph can be drawn to pass through the start point G3 and to be parallel to the "first" and "second" graphs. If slopes do not completely coincide with each other between the "first" and "second" graphs, the average of the slopes can be used. Incidentally, in the case where S8 in the flow of FIG. 6 is reached during use of the "first" photosensitive member unit 20, a new start point G2 can be determined on the basis of past results during the use period of the developing unit 32, and then the "second" graph can be drawn to be parallel to the "first" graph. In a case where there are no past results during the use period of the developing unit 32, if a standard value of the interval between the start points G1 and G2 is determined in advance, the standard value can be used. The above is the explanation of S8 in FIG. 6.

After estimating the extension amount of the lifetime of the developing unit 32, cost calculation is performed in a case of replacement of the developing unit 32 and in a case of replacement of the photosensitive member unit 20 (S9). FIG. 10 illustrates a table of parameters required for this calculation. In FIG. 10, a symbol "N" at the first row is the number of photosensitive member units 20 that have been used and discarded for the developing unit 32 at present. In the example in the above description of S8, the value of the "N" is "1".

A symbol "H" in the second row is the number of printed sheets for image formation that has been made from when the developing unit is replaced to the developing unit 32 at present to the present. The value of the "H" is counted for each execution of the image formation and is stored in the memory 79 of the controller 76. A symbol "R" in the third row is a value obtained by converting the extension amount of the lifetime calculated in S8 into the number of printed sheets. Since a proportional coefficient between the rotation time of the photosensitive member 21 and the number of printed sheets is known, this conversion is easy. A symbol "Udev" in the fourth row and a symbol "Upc" in the fifth row are purchase prices of the developing unit 32 and the photosensitive member unit 20, respectively. These purchase prices are stored in the memory 79 of the controller 76 in advance.

A symbol "a" in the sixth row is a wear rate of the photosensitive member unit 20 at present. The "a" is a ratio occupied by the current rotation time in the photosensitive member unit 20 at present with respect to the original rotatable time of the photosensitive member unit 20. In the example of FIG. 9, it can be considered that the "α" corresponds to a value obtained by dividing a length D by a length Q and multiplying by 100. If the rotation time of "present" in FIG. 8 to the length D, the "α" is obtained by (7000 min/7500 min)×100, as 93%.

A symbol "β" in the seventh row in FIG. 10 is a wear rate of a new photosensitive member unit 20 of when the developing bias Vdc0 reaches the lower limit again by using the new photosensitive member unit 20 in a case where a photosensitive member unit 20 is replaced with the new photosensitive member unit 20. The "β" is a value smaller than "α" since the wear of the developing unit 32 progresses and the developing bias Vdc0 reaches the lower limit value at an early stage. In the example of FIG. 9, it can be considered that the "β" corresponds to a value obtained by dividing the length F by the length Q and multiplying by 100. Since the length F in FIG. 9 is 4000 min, the "β" is obtained by (4000 min/7500 min)×100, as 53%.

The cost calculation is performed on the basis of the parameters of FIG. 10 as described above. The following two costs are calculated here.

Figure 11:
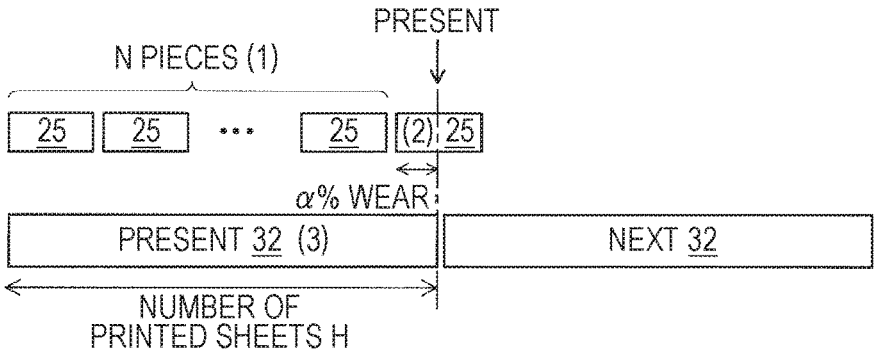
FIG. 11 is a schematic diagram illustrating a structure of cost calculation in a case where a developing unit is replaced immediately.

1. The cost per image formation for the developing unit 32 at present to be replaced, in a case where the developing unit 32 is replaced immediately (see FIG. 11)

Figure 12:
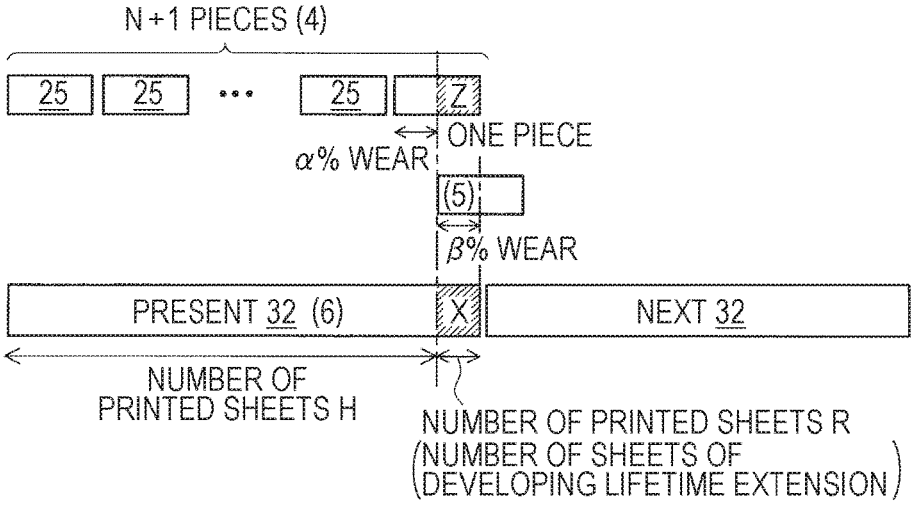
FIG. 12 is a schematic diagram illustrating a structure of cost calculation in a case where a photosensitive member unit is replaced, and the developing unit is replaced next time.

2. The cost per image formation for the developing unit 32 at present, in a case where the photosensitive member unit 20 is replaced immediately, and the developing unit 32 is replaced when the developing bias Vdc0 reaches the lower limit next time (see FIG. 12)

In the cost calculation of the above "1.", the denominator is "H" itself in FIG. 10. The numerator is a sum of the following three costs.

(1) Cost of the photosensitive member unit 20 already used for the developing unit 32 at present and discarded (2) Cost of an already consumed part of the total lifetime of the photosensitive member unit 20 currently in use (3) Cost of the developing unit 32 at present The cost of the above (1) is a product of the "N" and the "Upc" in FIG. 10. The cost of the (2) is the former of costs obtained by proportionally dividing the cost of the photosensitive member unit 20 currently in use between the number of printed sheets up to the present and the number of sheets that can be printed before the developing bias Vdc0 reaches the lower limit again after replacing the developing unit 32. The cost of the (2) is given by a product of the "Upc"

and the "α" (%) in FIG. 10. The cost of the (3) is the "Udev" in FIG. 10. Therefore, the cost of the "1." is given by the following equation.

$$\text{Cost}(1.)=[\{N+(a/100)\}\times Upc+Udev]/H \quad \text{[Expression 1]}$$

The denominator in the cost calculation of the above "2," is a sum of the "H" and the "R" in FIG. 10. The numerator is a sum of the following three costs.

(4) Cost of the photosensitive member unit 20 already used for the developing unit 32 at present (5) Cost to be consumed before the time of replacement of the developing unit 32, out of the total lifetime of the photosensitive member unit 20 to be newly mounted (6) Cost of the developing unit 32 at present Since the photosensitive member unit 20 currently in use is added, the cost of the above (4) is a greater value by an amount for the one unit than the cost of the (1) above. Therefore, the cost of the (4) is a product of "N+1" and the "Upc". The cost of the (5) is the former of costs obtained by proportionally dividing the cost of the photosensitive member unit 20 to be newly mounted, between the number of sheets that can be printed again before the developing bias Vdc0 reaches the lower limit after mounting, and the number of sheets that can be printed further after replacing the developing unit 32. The cost of the (5) is given by a product of the "Upc" and the "β" (%) in FIG. 10. The cost of the (6) is the same as the (3) above. Therefore, the cost of the "2." is given by the following equation.

$$\text{Cost}(2.)=[\{N+1+(\beta/100)\}\times Upc+Udev]/(H+R) \quad \text{[Expression 2]}$$

In this way, the cost calculation of S9 in FIG. 6 is performed. Subsequently, the costs are compared with each other (S10 in FIG. 6). If the cost of the "2," is tower than the cost of the "1.", to replace the photosensitive member unit 20 immediately is more advantageous than to replace the developing unit 32, in terms of cost. For that reason, in this case (S10: Yes), it is determined that the photosensitive member unit 20 is to be replaced (S11). Therefore, the image formation is stopped and a message is issued to the user prompting to replace the photosensitive member unit 20 with a new one. Alternatively, a message to the user is issued to the effect that the end of the lifetime is approaching of the photosensitive member unit 20.

On the other hand, if there is a cost merit in the cost of the "1." (S10: No), it is determined that the developing unit 32 is to be replaced (S5). Therefore, as described above, the image formation is stopped and a message is issued to the user prompting to replace the developing unit 32 with a new one. Alternatively, a message to the user is issued to the effect that the end of the lifetime is approaching of the developing unit 32.

Incidentally, the cost calculation and comparison in S9 and S10 compare the cost per image formation throughout the lifetime of the developing unit 32 at present. However, cost comparison, by another method may be used.

As the other method of cost comparison, for example, the following method is available. That is, it is a method of comparing parts to be wasted by being replaced, out of the developing unit 32 and the photosensitive member unit 20. In a case where the developing unit 32 is replaced in the situation as in the above example (FIG. 11), a remaining lifetime portion ("X" portion in FIG. 12) of the developing unit 32 currently in use is wasted. On the other hand, in a case where the photosensitive member unit 20 is replaced (FIG. 12), a remaining lifetime portion ("Z" portion in FIG. 12) of the photosensitive member unit 20 currently in use is wasted. Therefore, these remaining lifetime portions are compared, and the one is selected having the smaller cost (remaining value) of the wasted part. The costs of the "X" and "Z" portions are given by the following two equations.

$$\text{Cost}(X)=Udev\times\{R/(H+R)\}$$

$$\text{Cost}(Z)=Upc\times\{1-(\alpha/100)\} \quad \text{[Expression 3]}$$

As yet another method, there may be a method of simply setting a threshold value for the remaining value of the developing unit 32 in advance. It is a method of selecting replacement of the photosensitive member unit 20 when the remaining value of the developing unit 32 is greater than the threshold value, and selecting replacement of the developing unit 32 when the remaining value of the developing unit 32 falls below the threshold value. That is, when the remaining value of the developing unit 32 is large to some extent, the photosensitive member unit 20 is replaced, and when the remaining value of the developing unit 32 becomes small, the developing unit 32 is replaced. As the remaining value of the developing unit 32, the value of the above-described "X" or the aforementioned "R" can be used.

As described above in detail, according to the present embodiment, the adhesion amount adjustment control is performed at appropriate intervals in the image forming apparatus 1 in which the photosensitive member unit 20 and the developing unit 32 are detachable independently of each other. On the basis of the developing bias Vdc0 determined at that time, it is determined whether or not to replace the photosensitive member unit 20 or the developing unit 32, and which one is to be replaced when replacing the photosensitive member unit 20 or the developing unit 32. Here, basically, the photosensitive member unit 20 is replaced, and in a case where a predetermined developing device replacement matter occurs, the developing unit 32 is replaced. As a result, the inexpensive photosensitive member unit 20 is replaced, as far as it is possible. Thus, the image forming apparatus 1 is provided capable of executing the image formation while minimizing cost burden.

Incidentally, the present embodiment is merely an example and does not limit the present invention at all. Therefore, various improvements and modifications can be made within the scope not departing from the gist of the present invention. For example, the targeted image forming apparatus 1 may be a monochrome type, or may have both a scanner function and an external transmission/reception function of a print job. In addition, various developing device replacement matters are illustrated in FIG. 6; however, the order of these need not be as illustrated. Further, it may be possible to perform only a part of the developing device replacement matters illustrated in FIG. 6. Incidentally, for the "R" in FIG. 10, there may be a simplified method in which the limit number of printable sheets of the developing unit 32 is determined in advance and the remainder thereof is set to "R".

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a photosensitive member that rotates; a charger that charges a surface of the photosensitive member; an exposure device that forms a latent image on a position of the surface of the photosensitive member charged by the charger; and a developing device that applies toner to the latent image to form a toner image, wherein the photosensitive member is incorporated in a detachable photosensitive member unit, and the developing device is incorporated in a detachable developing unit, the image forming apparatus including:

an optimization controller that performs optimization of a charging bias of the charger and a developing bias of the developing device at time of non-image formation; and a replacement determiner that determines which of the photosensitive member unit and the developing unit is to be replaced when an optimized developing bias that is the developing bias at time of optimization by the optimization controller is out of a predetermined allowable range, wherein the replacement determiner determines that the developing unit is to be replaced in a case where a usage situation until then corresponds to a predetermined developing device replacement matter, and determines that the photosensitive member unit is to be replaced in a case where it is not determined that the developing unit is to be replaced.

2. The image forming apparatus according to claim 1, wherein the developing device replacement matter in determination by the replacement determiner includes that the optimized developing bias exceeds an upper limit of the allowable range.

3. The image forming apparatus according to claim 1, further comprising:

a replacement history storage that stores a replacement history of the photosensitive member unit and the developing unit, wherein the developing device replacement matter in determination by the replacement determiner includes that a number of times of replacement of the photosensitive member unit after the developing unit at present is mounted is equal to or greater than a predetermined reference number of times.

4. The image forming apparatus according to claim 1, further comprising a developing bias history storage that stores a history of the optimized developing bias, wherein the developing device replacement matter in determination by the replacement determiner includes that variation of a predetermined number of times of the optimized developing biases in the most recent past is equal to or greater than a predetermined upper limit variation.

5. The image forming apparatus according to claim 1, further comprising:

a developing bias history storage that stores a history of the optimized developing bias;

a count-up value storage that stores a number of printed sheets and a count-up value of a number of rotations of the photosensitive member; and a replacement history storage that stores a replacement history of the photosensitive member unit and the developing unit, wherein the replacement determiner calculates, when performing the determination, on the basis of stored contents of the developing bias history storage, the count-up value storage, and the replacement history storage, and a unit price of each of the photosensitive member unit and the developing unit, a first printing unit price that is a value obtained by dividing a total price of the developing unit at present and the photosensitive member unit used for the developing unit by a number of sheets printed by the developing unit at present, in a case of replacing the developing unit, and a second printing unit price that is a value obtained by dividing a total price of the developing unit at present and the photosensitive member unit to be used for the developing unit by a number of sheets to be printed by the developing unit at present, in a case of replacing the photosensitive member unit, and the developing device replacement matter in determination by the replacement determiner includes that the first printing unit price is lower than the second printing unit price.

6. The image forming apparatus according to claim 5, wherein in the replacement determiner, a numerator in calculation of the first printing unit price is set to a value obtained by adding, to a total price of the developing unit at present and the photosensitive member unit that has already been fully used for the developing unit, the former of prices obtained by proportionally dividing a unit price of the photosensitive member unit at present between a number of printed sheets up to the present and a number of sheets that can be printed before the optimized developing bias falls outside the allowable range again after replacing the developing unit, a numerator in calculation of the second printing unit price is set to a value obtained by adding, to a total price of the developing unit at present, the photosensitive member unit that has already been fully used for the developing unit, and the photosensitive member unit at present, the former of prices obtained by proportionally dividing a unit price of the photosensitive member unit to be newly mounted, between the number of sheets that can be printed before the optimized developing bias falls outside the allowable range again after mounting, and a number of sheets that can be printed further after replacing the developing unit, and a denominator in the calculation of the second print unit price is set to a sum of the number of sheets printed by the developing unit at present, and the number of sheets that can be printed before the optimized developing bias falls outside the allowable range again after replacing the photosensitive member unit.

7. The image forming apparatus according to claim 1, further comprising:

a count-up value storage that stores a number of printed sheets and a count-up value of a number of rotations of the photosensitive member;

a replacement history storage that stores a replacement history of the photosensitive member unit and the developing unit; and a remaining value calculator that calculates at least the former of a remaining value of the developing unit at present and a remaining value of the photosensitive member unit at present on the basis of stored contents of the count-up value storage and the replacement history storage, and a unit price of each of the photosensitive member unit and the developing unit, wherein the developing device replacement matter in determination by the replacement determiner includes that the remaining value of the developing unit at present is lower than a predetermined comparison object.

8. The image forming apparatus according to claim 7, wherein the remaining value calculator calculates both the remaining value of the developing unit at present and the remaining value of the photosensitive member unit at present, and the predetermined comparison object is the remaining value of the photosensitive member unit at present.

9. A non-transitory recording medium storing a computer readable program for an image forming apparatus, the program controlling the image forming apparatus including: a photosensitive member that rotates; a charger that charges a surface of the photosensitive member; an exposure device that forms a latent image on a position of the surface of the photosensitive member charged by the charger; and a developing device that applies toner to the latent image to form a toner image, wherein the photosensitive member is incorporated in a detachable photosensitive member unit, and the developing device is incorporated in a detachable developing unit, the program causing a computer to perform:

optimizing a charging bias of the charger and a developing bias of the developing device at time of non-image formation; and determining which of the photosensitive member unit and the developing unit is to be replaced when an optimized developing bias that is the developing bias at time of optimization by the optimizing is out of a predetermined allowable range, wherein the determining includes:

determining that the developing unit is to be replaced in a case where a usage situation until then corresponds to a predetermined developing device replacement matter, and determining that the photosensitive member unit is to be replaced in a case where it is not determined that the developing unit is to be replaced.

10. The non-transitory recording medium storing a computer readable program for an image forming apparatus according to claim 9, wherein the developing device replacement matter in determination by the determining includes that the optimized developing bias exceeds an upper limit of the allowable range.

11. The non-transitory recording medium storing a computer readable program for an image forming apparatus according to claim 9, wherein the image forming apparatus as an object includes a replacement history storage that stores a replacement history of the photosensitive member unit and the developing unit, and the developing device replacement matter in determination by the determining includes that a number of times of replacement of the photosensitive member unit after the developing unit at present is mounted is equal to or greater than a predetermined reference number of times.

12. The non-transitory recording medium storing a computer readable program for an image forming apparatus according to claim 9, wherein the image forming apparatus as an object includes a developing bias history storage that stores a history of the optimized developing bias, and the developing device replacement matter in determination by the determining includes that variation of a predetermined number of times of the optimized developing biases in the most recent past is equal to or greater than a predetermined upper limit variation.

13. The non-transitory recording medium storing a computer readable program for an image forming apparatus according to claim 9, wherein the image forming apparatus as an object includes: a developing bias history storage that stores a history of the optimized developing bias; a count-up value storage that stores a number of printed sheets and a count-up value of a number of rotations of the photosensitive member; and a replacement history storage that stores a replacement history of the photosensitive member unit and the developing unit, the determining calculates, when performing the determination, on the basis of stored contents of the developing bias history storage, the count-up value storage, and the replacement history storage, and a unit price of each of the photosensitive member unit and the developing unit, a first printing unit price that is a value obtained by dividing a total price of the developing unit at present and the photosensitive member unit used for the developing unit by a number of sheets printed by the developing unit at present, in a case of replacing the developing unit, and a second printing unit price that is a value obtained by dividing a total price of the developing unit at present and the photosensitive member unit to be used for the developing unit by a number of sheets to be printed by the developing unit at present, in a case of replacing the photosensitive member unit, and the developing device replacement matter in determination by the determining includes that the first printing unit price is lower than the second printing unit price.

14. The non-transitory recording medium storing a computer readable program for an image forming apparatus according to claim 13, wherein in the determining, a numerator in calculation of the first printing unit price is set to a value obtained by adding, to a total price of the developing unit at present and the photosensitive member unit that has already been fully used for the developing unit, the former of prices obtained by proportionally dividing a unit price of the photosensitive member unit at present between a number of printed sheets up to the present and a number of sheets that can be printed before the optimized developing bias falls outside the allowable range again after replacing the developing unit, a numerator in calculation of the second printing unit price is set to a value obtained by adding, to a total price of the developing unit at present, the photosensitive member unit that has already been fully used for the developing unit, and the photosensitive member unit at present, the former of prices obtained by proportionally dividing a unit price of the photosensitive member unit to be newly mounted, between the number of sheets that can be printed before the optimized developing bias falls outside the allowable range again after mounting, and a number of sheets that can be printed further after replacing the developing unit, and a denominator in the calculation of the second print unit price is set to a sum of the number of sheets printed by the developing unit at present, and the number of sheets that can be printed before the optimized developing bias falls outside the allowable range again after replacing the photosensitive member unit.

15. The non-transitory recording medium storing a computer readable program for an image forming apparatus according to claim 9, wherein the image forming apparatus as an object includes a count-up value storage that stores a number of printed sheets and a count-up value of a number of rotations of the photosensitive member and a replacement history storage that stores a replacement history of the photosensitive member unit and the developing unit, the determining, when performing determination, includes calculating at least the former of a remaining value of the developing unit at present and a remaining value of the photosensitive member unit at present on the basis of stored contents of the count-up value storage and the replacement history storage, and a unit price of each of the photosensitive member unit and the developing unit, and the developing device replacement matter in determination by the determining includes that the remaining value of the developing unit at present is lower than a predetermined comparison object.

16. The non-transitory recording medium storing a computer readable program for an image forming apparatus according to claim 15, wherein the calculating includes calculating both the remaining value of the developing unit at present and the remaining value of the photosensitive member unit at present, and the predetermined comparison object is the remaining value of the photosensitive member unit at present.

* * * * *